US005205543A

United States Patent [19]

Thiede

[11] Patent Number: 5,205,543

[45] Date of Patent: Apr. 27, 1993

[54] CHAIN LINKING DEVICE

[76] Inventor: Perry C. Thiede, 31331 Kenady La., Cottage Grove, Oreg. 97424

[21] Appl. No.: 655,809

[22] Filed: Feb. 15, 1991

[51] Int. Cl.[5] ..... B25B 27/22

[52] U.S. Cl. ..... 254/231

[58] Field of Search ..... 254/231, 232, 233, 234, 254/235, 236

[56] References Cited

U.S. PATENT DOCUMENTS

| | | | |
|---|---|---|---|
| 752,074 | 2/1904 | Jackson | 254/231 |
| 775,355 | 11/1904 | Smith | 254/231 |
| 1,373,230 | 3/1921 | Gainor | 254/231 |
| 1,489,123 | 4/1924 | Heatherington | 254/231 |
| 1,741,785 | 12/1929 | Lynch | 254/231 |
| 1,817,628 | 8/1931 | Kessler et al. | 254/231 |
| 4,201,367 | 5/1980 | Konen, Sr. | 254/231 |
| 4,367,862 | 1/1983 | McGregor | 254/231 |

*Primary Examiner*—Katherine Matecki
*Attorney, Agent, or Firm*—John F. Ingman

[57] ABSTRACT

A chain linking device utilizes a rod of steel round stock, wherein one end of the rod is bent to form a hook while the remaining straight section is threaded. A sleeve and pin member includes a sleeve, with an inner diameter slightly larger than the round stock which fits over the threaded portion of the round stock. A straight pin is formed with or attached to the sleeve so as to protrude radially outward. A washer and a nut are located on the threaded round stock following the sleeve. In use, the hook on the end of the rod is inserted in a gap within the chain several links removed from a free end of the separated or broken chain. The pin on the sleeve and pin member then is inserted in a comparable location several links removed from the other free end of the separation. A wrench is used to rotate the nut, so as to force the sleeve and pin member along the threaded rod toward the hooked end, which movement pulls the separated ends of the chain closer together and holds them in position so as to allow the insertion of a master-type or repair link to connect the break or separation.

4 Claims, 1 Drawing Sheet

CHAIN LINKING DEVICE

BACKGROUND OF THE INVENTION

1. Field of the Invention

This invention involves a chain linking device, and, more particularly, a device which will draw the ends of a separated or broken roller chain together to allow connection.

2. Description of the Prior Art

Chains, particularly roller chains, are used in combination with sprockets to power a variety of types of machinery, from industrial uses such as conveyors to common motorcycle and bicycle chains. When roller chains in industrial applications break, they normally are repaired in-place by the use of a replacement or master link. This requires the separated ends of the break to be drawn together. Connection may be accomplished manually by several persons, with one person, or even two persons with a heavy chain, holding the ends together and an additional person installing the replacement link.

What is needed is a lightweight, portable tool which allows a single person to quickly and simply draw the ends of a broken roller chain together and repair the break.

SUMMARY OF THE INVENTION

The present invention provides a chain linking device designed to meet the aforementioned need.

The preferred embodiment utilizes a rod of steel round stock, wherein one end of the rod is bent to form a hook while the remaining straight section is threaded. A sleeve and pin member includes a sleeve, with an inner diameter slightly larger than the round stock, which fits over the threaded portion of the round stock. A straight pin is formed with or attached to the sleeve so as to protrude radially outward. A washer and a nut are located on the threaded round stock following the sleeve.

In use, the hook on the end of the rod is inserted in a gap within the chain several links removed from a free end of the separated or broken chain. The pin on the sleeve and pin member then is inserted in a comparable location several links removed from the other free end of the separation. A wrench is used to rotate the nut, so as to force the sleeve and pin member along the threaded rod toward the hooked end, which movement pulls the separated ends of the chain closer together and holds them in position so as to allow the insertion of a master-type or repair link to connect the break or separation.

DESCRIPTION OF THE PREFERRED EMBODIMENT

Figure 1:
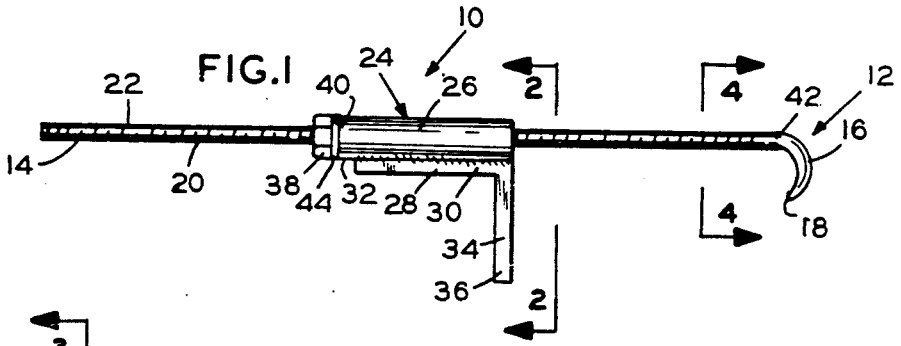
FIG. 1 illustrates a side elevation view of the chain linking device.
Figure 2:
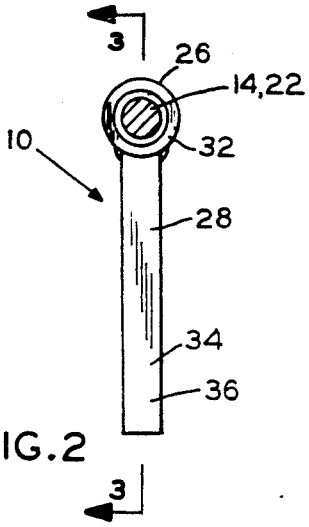
FIG. 2 illustrates a cross-sectional view as seen at line 2—2 of FIG. 1.
Figure 4:
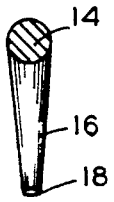
FIG. 4 illustrates a cross-sectional view as seen at line 4—4 of FIG. 1.
Figure 3:
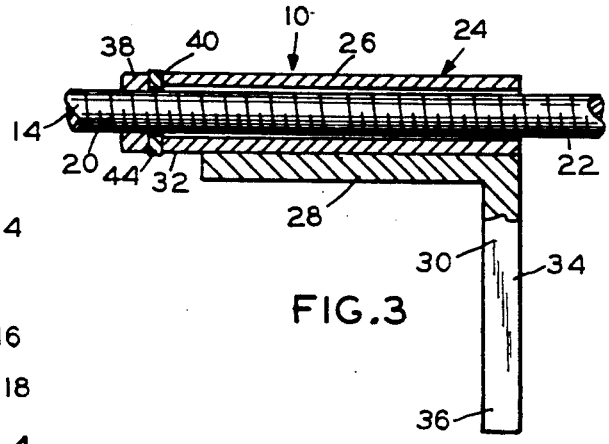
FIG. 3 illustrates a cross-sectional view as seen at line 3—3 of FIG. 2.

Turning now to the drawings, there is shown in FIG. 1 the chain linking device 10 of the present invention.

In the preferred embodiment, an elongated member 12, such as a rod 14 formed from a section of 3/8-inch diameter steel round stock, is shaped to have one end curved in a generally semi-circular pattern to form a hook 16. The hook 16 is preferably tapered towards its end 18 and curves between 90 and 135 degrees. Threads 20 are formed on the remaining straight portion 22 of the rod 14.

A sleeve and pin member 24 may be formed by a length of sleeve 26, as formed from a section of pipe, with an inner diameter slightly larger than the threaded rod 14, which fits over the threaded straight portion 22 of the rod 14. An "L" shaped member 28, which may be formed from a length of steel having a square cross section as commonly used in a key for fastening a wheel or pulley to a shaft and known as key stock, is attached, as by welding one leg 30 to the exterior 32 of the sleeve 26, so that the second leg 34 of the "L"-shaped member 28 forms a pin 36 which protrudes radially outward. A pin 36 which protrudes approximately one to two inches works well. The sleeve and pin member 24 is slipped onto the threaded rod 14 so that the pin 36 is near the hook 16. While the currently preferred construction of the sleeve and pin member 24 involves the attachment of an "L"-shaped member 28 to a length of sleeve 26 to form the pin 36, it is clear that the sleeve and pin member 24 may be integrally formed in a single piece or otherwise constructed.

A nut 38 is engaged with the threaded rod 14 following the sleeve and pin member 24 so as to abut the end 40 of the sleeve 26 away from the hook end 42 of the rod 14. It is preferable that a washer 44 be utilized between the nut 38 and the end 40 of the sleeve 26 to provide a smooth bearing surface for the nut 38.

Figure 5:
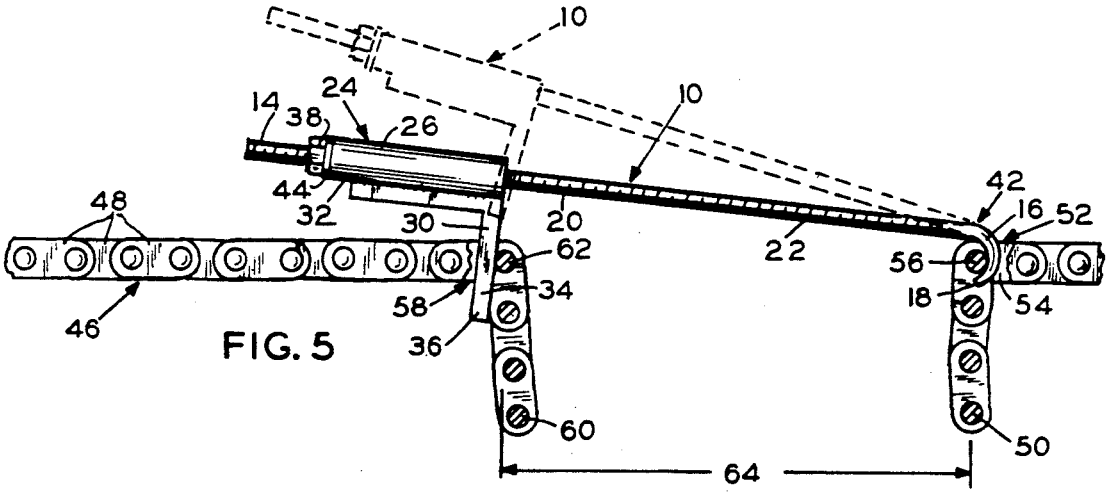
FIG. 5 illustrates the chain linking device of FIG. 1 in process of being applied to a separated roller chain.

In use, the hook 16 on the hook end 42 of the rod 14 is attached to the roller chain 46 several links 48 away from one of the separated free ends 50. The hook 16 is inserted within a link 48 in the gap 52 between the spaced side plates 54 and behind a roller 56. The pin 36 of the chain linking device 10 is then inserted in a similar gap 58 behind roller 62 several links 48 away from the other free end 60 of the separated roller chain 42. A straight pin 36 design of the chain linking device 10 is found to be advantageous in permitting insertion of the pin 36 into a gap 58 behind roller 62 without requiring additional slack in the roller chain 46 as would be required to permit the entry of a hook-type connection. FIG. 5 illustrates, in the dotted lines, the initial insertion of the pin 36 in the gap 58, the hook 16 having already been inserted within gap 52. The curved shape of the hook 16 allows the hook 16 to grasp the roller 56 both initially and as the chain linking device 10 is rotated downward so as to fully insert the pin 36 in the gap 58 behind roller 62.

Figure 6:
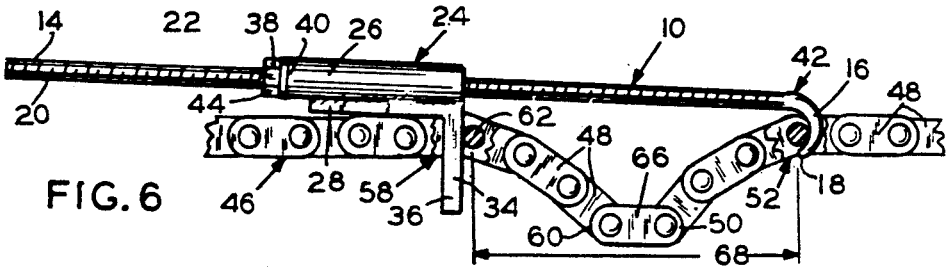
FIG. 6 illustrates the chain linking device of FIG. 5 where the separated ends of the chain have been drawn together for connection.

Once the chain linking device 10 securely bridges the separation 64 between rollers 56 and 62, the nut 38 is rotated upon the threads 20, as by a wrench (not shown), so as to force the sleeve and pin member 24 along the threaded rod 14 toward the hook end 42. Thereby, the hook 16 and pin 34 draw the rollers 56 and 62 and their respective separated ends 50 and 60 of the roller chain 46 together sufficient)y so as to allow the separated ends 50 and 60 to be simply and conveniently attached by means of a replacement or master link 66 or other connecting means. It Is preferable that the rollers 56 and 62, which are used to draw the ends 50 and 60 of the chain closer, are not at the ends 50 and 60 but rather several chain links 48 therefrom, so as to allow the ends 50 and 60 to be maneuvered in a slack condition to facilitate the joining of the replacement or master link 66 thereto. The chain linking device 10 allows one person to conveniently draw the ends 50 and 60 of a separated roller chain 46 together so that the chain 46 may be connected, and securely hold these rollers 56 and 62 in such position until the connection has been completed. In FIG. 6, the roller chain 46 has been drawn together to a substantially reduced separation 68 by the chain linking device 10 and a new link 66 added to complete the connection between the slack ends 50 and 60. Following connection, the nut 38 is backed off until slack and the roller chain tightener 10 removed from the roller chain 46.

While the above description of use concerns the or connection of separated ends 50 and 60 of the chain 46, the chain linking device 10 also finds valuable use in the disassembly or separation of links 48 of the chain 46 by pulling links 48 together so as to create sufficient slack on the chain 46 to allow easy link 48 separation or removal.

It is thought that the chain linking device of the present invention and its many attendant advantages will be understood from the foregoing description and that it will be apparent that various changes may be made in form, construction and arrangement of the parts thereof without departing from the spirit and scope of the invention or sacrificing all of its material advantages, the forms hereinbefore stated being merely exemplary embodiments thereof.

I claim:

1. A chain linking device, in combination with a chain including a plurality of links in series, the chain linking device comprising:

a. an elongated member having a straight portion, with a longitudinal axis, and a curved portion, with the curved portion being located at one end of the straight portion; said curved portion of said elongated member being formed in an arc of greater than ninety degrees so as to form a hook having a concave link-engaging surface; said straight portion of said elongated member being externally threaded;

b. a sleeve member formed to slidingly engage said elongated member; said sleeve member being formed with a straight pin member which extends radially outwards from said sleeve member, said pin member having a straight and uninterrupted link-engaging surface which is substantially perpendicular to the longitudinal axis of the straight portion of the elongated member; and c. an internally threaded member formed to threadingly engage said externally elongated member;

d. said sleeve member being located upon the elongated member between the internally threaded member and the curved portion of the elongated member.

2. The chain linking device, as recited in claim 1, where the curved portion of the elongated member is formed in an arc of less than 135-degrees.

3. The chain linking device, as recited in claim 1, wherein the straight pin member is formed of one log of an L-shaped section of square steel stock which is joined to said sleeve member so that said leg protrudes radially outwards from said sleeve member, providing a flat link-engaging surface.

4. The chain linking device, as recited in claim 1, wherein the curved portion of the elongated member which forms a hook is tapered.

* * * * *